US005928010A

United States Patent [19]

Katsuma et al.

[11] Patent Number: 5,928,010

[45] Date of Patent: Jul. 27, 1999

[54] LOCKING APPARATUS FOR RESIN MOULDED PRODUCT

[75] Inventors: Takatoshi Katsuma; Hiroyuki Nakata, both of Yokkaichi, Japan

[73] Assignee: Sumitomo Wiring Systems, Ltd., Japan

[21] Appl. No.: 08/843,387

[22] Filed: Apr. 15, 1997

[30] Foreign Application Priority Data

Jun. 5, 1996 [JP] Japan ..... 8-143204

[51] Int. Cl.[6] ..... H01R 13/62

[52] U.S. Cl. ..... 439/157

[58] Field of Search ..... 439/157, 328, 439/350, 352, 353, 354, 357, 358, 344, 345, 595; 24/615, 616, 625, 323, 313

[56] References Cited

U.S. PATENT DOCUMENTS

| | | | |
|---|---|---|---|
| 3,639,950 | 2/1972 | Lutz et al. | 439/350 |
| 4,688,337 | 8/1987 | Dillner et al. | 24/616 |
| 4,971,580 | 11/1990 | Ward et al. | 439/595 |
| 5,169,329 | 12/1992 | Taguchi | 439/354 |
| 5,476,391 | 12/1995 | Katsuma | 439/157 |
| 5,496,190 | 3/1996 | Ittah et al. | 439/357 |
| 5,512,833 | 4/1996 | Fukuda | 439/489 |

FOREIGN PATENT DOCUMENTS

| | | | |
|---|---|---|---|
| 0 532 366 | 3/1993 | European Pat. Off. . | |
| 0 654 862 | 5/1995 | European Pat. Off. . | |
| 60-105083 | 7/1985 | Japan . | |
| 61-63782 | 4/1986 | Japan . | |
| 61-120182 | 7/1986 | Japan . | |
| 62-109370 | 7/1987 | Japan . | |
| 2-49080 | 4/1990 | Japan . | |
| 2-150774 | 12/1990 | Japan . | |
| 1315693 | 5/1973 | United Kingdom | 439/595 |

*Primary Examiner*—Paula Bradley
*Assistant Examiner*—Tho D. Ta
*Attorney, Agent, or Firm*—Banner & Witcoff, Ltd.

[57] ABSTRACT

In a latching member of a molded component, a facing face (19A) of a release member (19) located at an anterior end of a resilient latching member (17) is made parallel to a stopping face (18B) of a protrusion (18). By doing this, the moulding of the stopping face (18B) is carried out by a mould part (20C) whose mould opening direction is parallel to the stopping face (18B) and the facing face (19A), thus obviating the need to leave a mould removing hole in the release member (19).

16 Claims, 5 Drawing Sheets

LOCKING APPARATUS FOR RESIN MOULDED PRODUCT

TECHNICAL FIELD

The present invention relates to a locking device of the kind comprising a protrusion provided on a resin or plastic moulded article to be retained in a corresponding recess.

BACKGROUND TO THE INVENTION

In, for example, a lever type electrical connector, of the kind which allows a pair of connectors to be fitted together by means of a cam and corresponding rotation of a lever, a latching device is provided for retaining the lever in a closed position.

As shown in FIG. 8 of this specification, a prior latching device has a resin or plastic moulded lever 1 comprising a cantilevered latching member 2, a protrusion 3 formed on the outer face of the latching member 2; and a cover 4 corresponding to the lever 1 and with a stopping hole 5 formed thereon. When the lever 1 reaches the closed position of FIG. 8, the latching member 2 bends resiliently, and the protrusion 3 fits in the hole 5. Consequently, the removal of the lever 1 from the cover 4 is controlled, the lever 1 being resiliently retained. In order to release the latch, a release member 6 located on the anterior end of the latching member 2 is pressed downwards. This causes the latching member 2 to bend, resulting in the protrusion 3 separating from the stopping hole 5 and allowing the lever 1 to be moved to the open position. As shown in FIG. 9, in the latched position, a latching face 3A of the protrusion 3 is diagonally angled with respect to the exterior face of the latching member 2. Accordingly the protrusion 3 engages the stopping hole 5 firmly, resulting in an increase in reliability of the locking operation. Such a latching arrangement is very well known.

In the conventional latching device, the inclined latching face 3A is moulded integrally. However the lever cannot easily be removed from a mould tool because of the acute angle between the latching face 3A and the upstanding release member 6. Accordingly a hole 7 must be provided for a movable mould insert, and this substantially increases the cost of the mould tool and the moulding time. Furthermore the hole 7 weakens the release member 6 which consequently must be made wider or thicker than is necessary for function.

FIG. 10 illustrates the mould tool insert 8 which must be inserted in the direction of arrow 9 and withdrawn before the lever can be removed from the mould.

The present invention has been developed after taking the above circumstances into account, and aims to maintain and improve the strength of the operating member.

SUMMARY OF THE INVENTION

According to the invention there is provided a moulded component having a resilient latching member with a protrusion and a release arm thereon, the protrusion and release arm extending substantially in the same direction, and said protrusion being adapted for latching engagement in a recess of a corresponding part, wherein said protrusion has an abutment face facing said release arm, the abutment face overhanging said latching member at an acute angle thereto, and wherein the release arm has an inner face facing said protrusion, said inner face and abutment face being parallel or diverging in said same direction.

Such a component retains the overhanging abutment face which gives a superior retention effect, yet is easy to mould since the parallel or diverging faces permit a mould part to be withdrawn. A mould insert and the troublesome aperture in the release arm are avoided. The release arm can be smaller for a given release load, or the release arm can be stronger since the through aperture is not present.

Preferably the inner face is longer than the abutment face, and in a preferred embodiment the abutment face and inner face of substantially the same width. Preferably these faces are substantially rectangular and flat.

In a preferred embodiment the latching member is a cantilevered arm moulded of resilient plastics material.

Preferably the release arm is substantially perpendicular to the direction of fitting of said latching member with a corresponding part.

BRIEF DESCRIPTION OF THE DRAWINGS

Other features of the invention will be apparent from the following description of several preferred embodiments shown by way of example only in the accompanying drawings in which.

DESCRIPTION OF PREFERRED EMBODIMENTS

Embodiment 1 of the present invention is explained hereinbelow, with reference to FIGS. 1 to 5.

Figure 2:
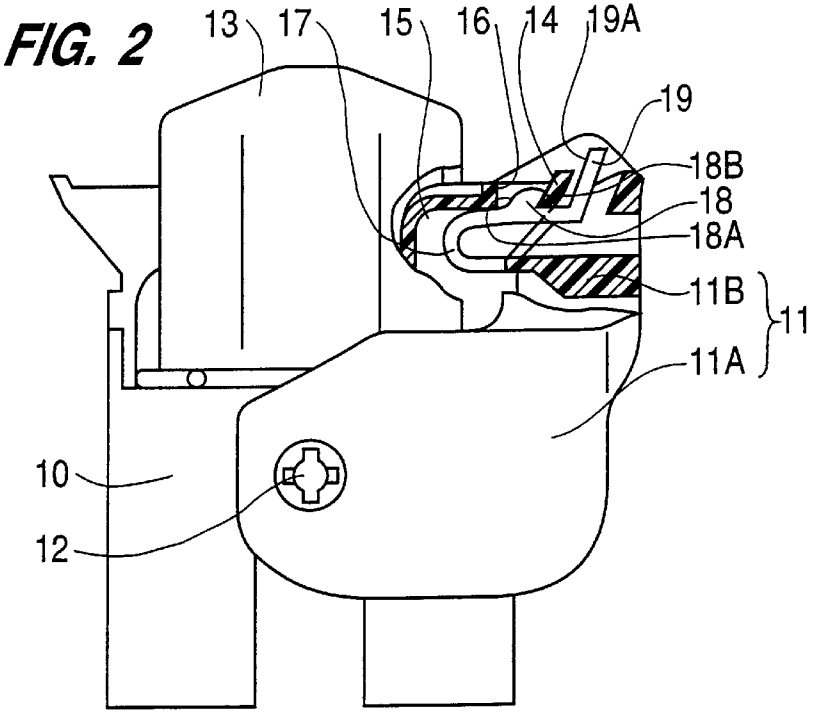
FIG. 2 is a partially cut away side view of embodiment 1 showing the lever in the latched position.
Figure 1:
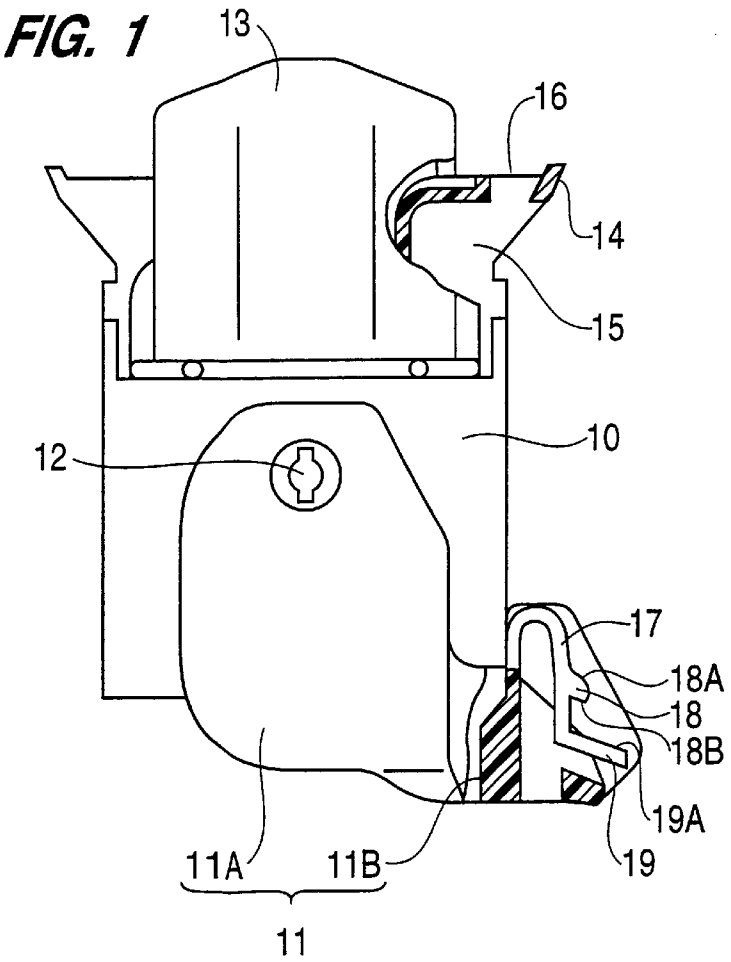
FIG. 1 is a partially cut away side view of embodiment 1 of the present invention showing the lever in the open position.

FIGS. 1 and 2 show a lever type connector 10 made from synthetic resin material. A lever 11 (a resin or plastic moulded article) is attached thereon in a pivotable manner about a rotative axis 12. In the state, shown in FIG. 1, where the lever 11 is in the release position, a corresponding connector (not shown) is brought to the lower face of the connector 10. At the same time, a cam pin of this corresponding connector is fitted into a cam groove (not shown) located in the lever 11. From this state, when the lever 11 is pivoted in an anti-clockwise direction with respect to FIG. 1, due to the cam effect the corresponding connector is pulled into engagement with connector 10. When the lever 11 reaches the final position, the fitting of both the connectors is completed, and, as described further on, the lever 11 is latched in its final position.

In order to latch the lever 11, the locking device is configured as follows.

The connector 10 has a cover 13 attached thereon for protecting an electric wire (not shown) that protrudes at an angle from the upper face of the connector 10. The side face of the cover 13 has a receiving member 14 formed therein, this receiving member 14 corresponding to the lever 11 when it reaches the final position. The receiving member 14 connects the anterior ends of a pair of supporting members 15 protruding from the cover 13. The empty space enclosed by the receiving member 14 and the supporting members 15 forms a stopping hole 16 into which a protrusion 18 of the lever 11 is fitted, as described later. The lever 11 is latched when the protrusion 18 is engaged in the receiving member.

The lever 11 comprises a pair of arms 11A supported axially on the connector 10, and a connecting member 11B that connects the arms 11A by forming a bridge across them. This connecting member 11B has a resilient cantilevered member 17 formed in a U-shape so as to be approximately parallel to the connecting member 11B, the U-shape bend extending from the anterior end of the lever 11 to the outside. This resilient member 17 is designed to bend elastically towards and away from the connecting member 11B.

The external face of the resilient member 17 has an integral protrusion 18 adapted to fit with the stopping hole 16 against the receiving member 14. This protrusion 18 has an arc shaped guiding face 18A facing the base of the resilient member 17 and a flat stopping face 18B facing the outer end of the resilient member 17.

The guiding face 18A is arranged to make contact with the receiving member 14 of the cover 13 from the exterior side. Due to the guiding face 18A making contact with the receiving member 14, the bending operation of the elastic bending member 17 is carried out smoothly as the lever 11 approaches the final position.

The stopping face 18B is arranged to be engaged with the receiving member 14 from the inner side of the stopping hole 16, the pivoting of the lever 11 from the final position to the release position being thus controlled. This stopping face 18B is not at a right angle with respect to the external face of the resilient member 17, but overhangs towards the anterior end in an inclined manner at an angle that is slightly less than 90 degrees with respect to this external face. Accordingly, it is less easy to release the protrusion 18 and the reliability of the latching operation increases.

Figure 5:
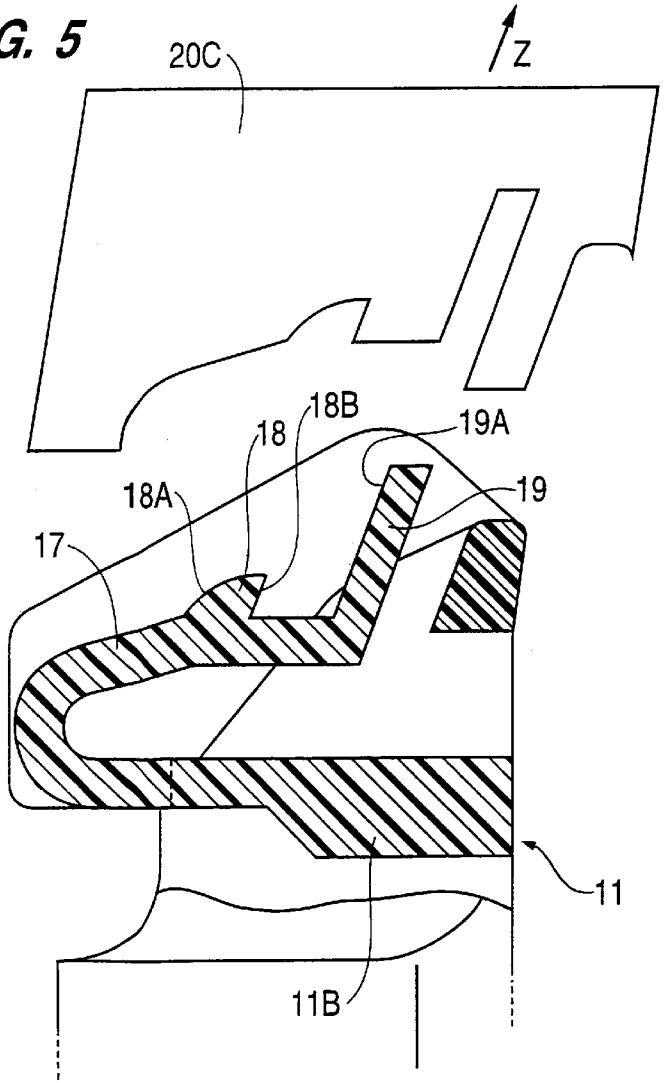
FIG. 5 is a cross-sectional view of embodiment 1 showing the mould open subsequent to the moulding of the bending member.

The anterior end of the resilient member 17 has an integral release member 19, which protrudes from the exterior face thereof. This release member 19 is provided for carrying out the latch release operation of the lever 11. In the latched state, when the release member 19 is pushed down, the resilient member 17 bends elastically and the protrusion 18 comes out of the stopping hole 16. As a result, the latch is released and the lever 11 can pivot to the open position. A facing face 19A that faces the stopping face 18B of the release member 19 forms a plane parallel face. By providing the facing face 19A parallel to the stopping face 18B, the moulding of the stopping face 18B is carried out not by a mould insert taken out from through the operating member 19, as in the conventional case, but as shown in FIG. 5, by means of a mould part 20C whose mould opening is parallel to the stopping face 18B and the facing face 19A, the opening of the mould proceeding from the resilient member 17 diagonally upwards.

Figure 4:
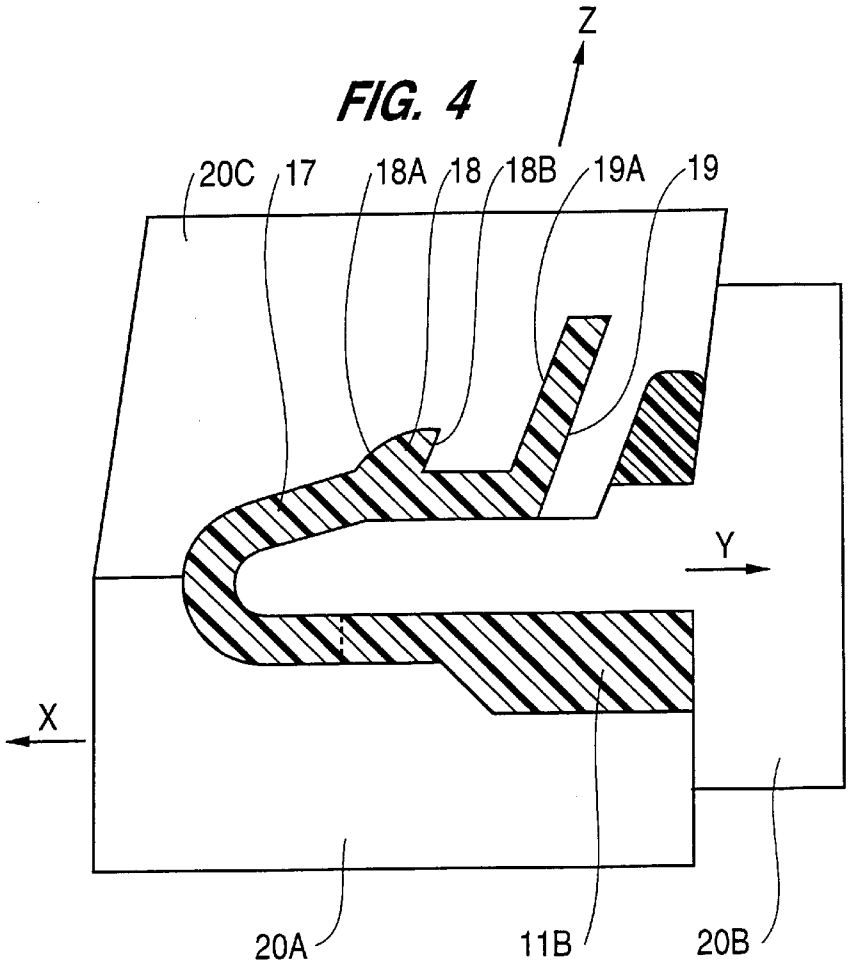
FIG. 4 is a cross-sectional view of embodiment 1 showing the mould parts of the bending member.
Figure 3:
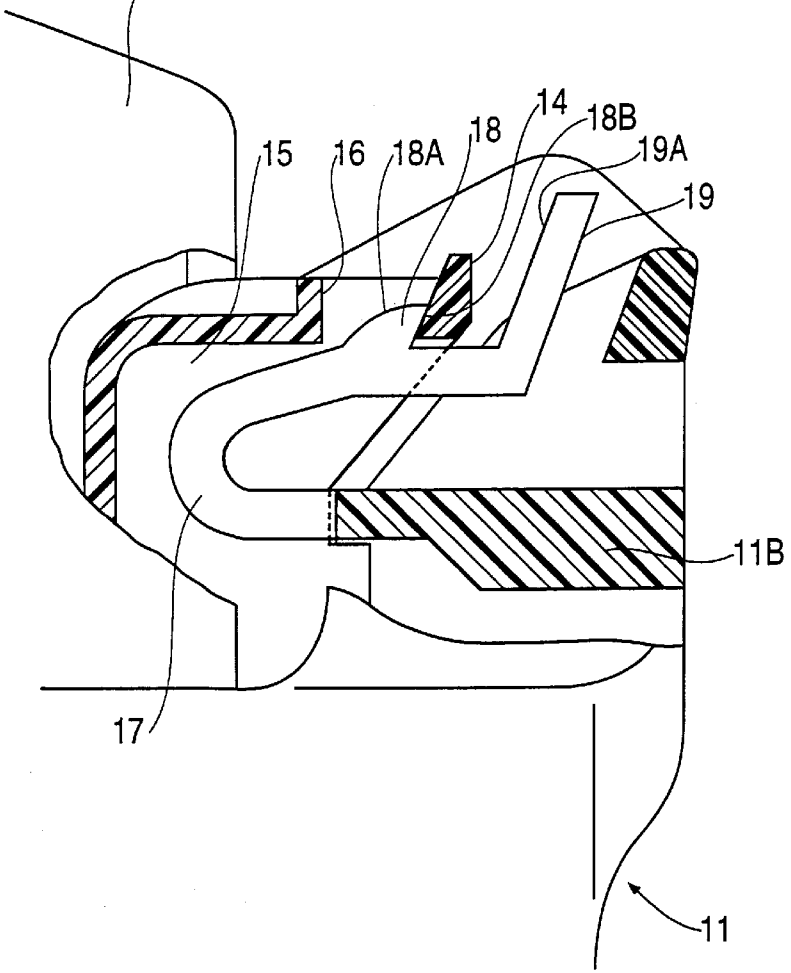
FIG. 3 is a partially cut away enlarged side view of embodiment 1 showing the lever in the latched position.

Next, the moulding process is explained. As shown in FIG. 4, three mould parts 20A, 20B and 20C are used to mould the connecting member 11B and the various parts of the resilient member 17. The first mould part 20A moulds the area extending from the lower face of the connecting member 11B to the lower half of the base end of the resilient member 17, the mould opening being carried in the left-hand direction shown by the arrow marked X, parallel to the lower face of the connecting member 11B. The second mould part 20B moulds the upper face of the connecting member 11B, the inner face of the resilient member 17, the lower face thereof, the mould opening being carried in the right-hand direction shown by the arrow marked Y, parallel to the upper face of the connecting member 11B.

The third mould part 20C moulds the area extending from the base of the resilient member 17 to the upper face thereof, the protrusion 18 and the release member 19. As shown by the arrows marked Z in FIGS. 4 and 5, the mould opening of the mould part 20C is carried out in a direction parallel to the stopping face 18B and the facing face 19A.

Consequently, there is no need to form a mould insert hole in the release member 19, unlike in the conventional case. In this way, greater strength of the release member 19 is achieved, or alternatively the release member can have a reduced width for the same strength.

Figure 6:
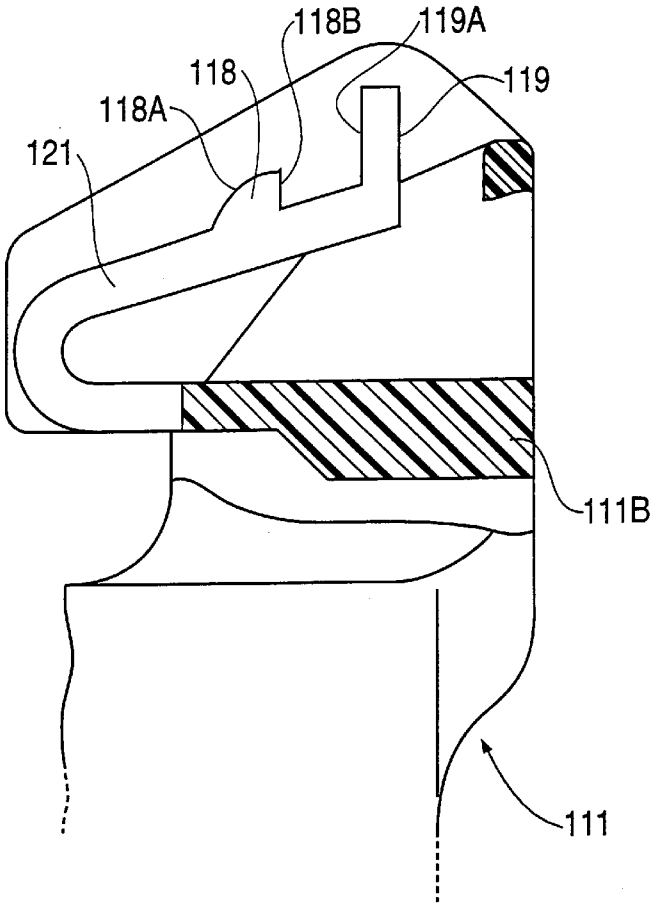
FIG. 6 is a partially cut away enlarged side view of embodiment 2.

Next, embodiment 2 of the present invention is explained hereinbelow, with reference to FIGS. 6 and 7. This embodiment differs from embodiment 1 with respect to the shape of the reslient bending member but is the same with respect to the rest of the configuration; accordingly the same numeral is accorded to common parts.

A lever 111 of embodiment 2 is moulded by means of a mould (not shown) whose mould opening is in a direction perpendicular (the up-down direction in FIGS. 6 and 7) to the direction of fitting (the left-right direction in FIGS. 6 and 7) of the lever 111 with a cover 113.

Compared to the case in embodiment 1 where the resilient member 17 extends approximately in a parallel manner with respect to the fitting direction of the cover 13, in embodiment 2 the resilient member 121 is shaped to extend linearly in an upward diagonal direction with respect to the fitting direction. Furthermore, a stopping face 118B of a protrusion 118 on the upper face of the resilient member 121 is formed to be parallel to the mould opening direction in the free state subsequent to the moulding. A facing face 119A of a release member 119 is formed so as to be parallel to the stopping face 118B.

When the lever 111 is fitted to the cover 113 and brought to the latched state, as shown in FIG. 7, since the resilient member 121 is forced to bend, due to its elastic recovery force it applies a strong pressing force against a receiving member 114 from below in an upward direction, that is, towards the direction of prevention of release of the protrusion 118 from the receiving member 114. In this manner, even in the case where other parts (not shown) interfere with the operating member 119, the resilient member 121 does not bend easily in the latch release direction, resulting in an increase in reliability of the latching operation.

In the state where the fitting with the cover 113 has not yet been effected, the stopping face 118B forms a right angle with respect to the fitting direction. However, by allowing the resilient member 121 to bend elastically as described above, it adopts an overhanging inclined position with respect to the fitting direction. Consequently, the stopped state of the protrusion 118 with the receiving member 114 is less easy to release and there is no loss in reliability of the locking operation.

Moreover, although the stopping face 118B is formed so as to be parallel to the mould removing direction of the mould part for the lever 111, it nevertheless inclines in an overhanging manner, as described above. Consequently, there is no need to prepare a special mould configuration, distinct from the mould configuration required for the lever 111, for making the stopping face 118B overhang. This results in a simplified configuration of the mould, and a reduction in the cost thereof.

Figure 7B:
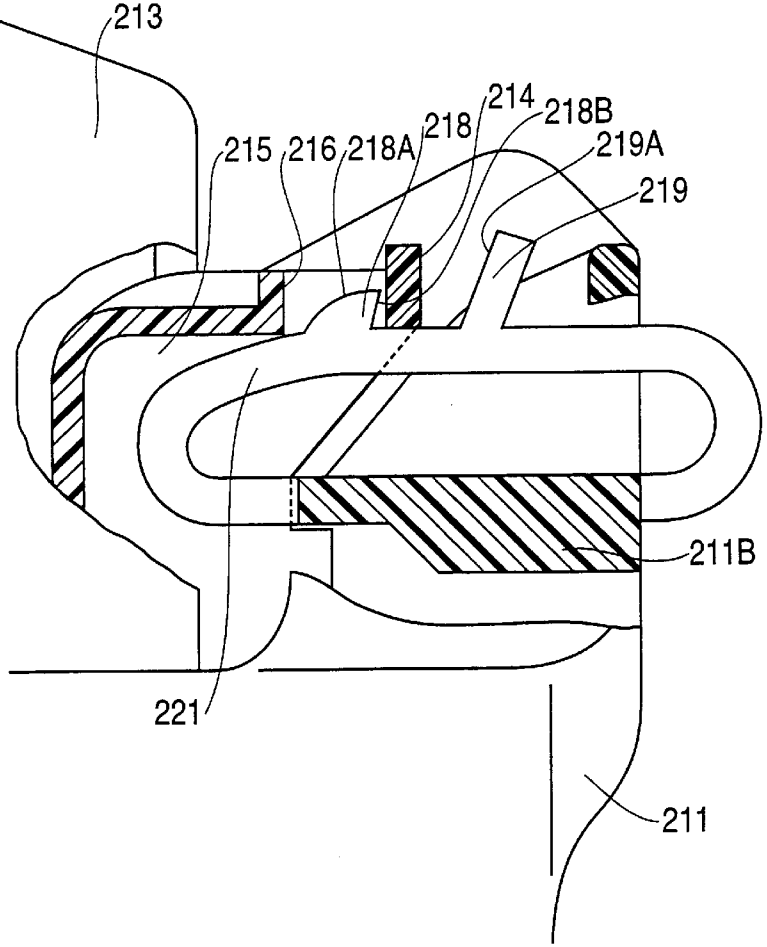
FIG. 7*b* is a variant of FIG. 7*a* showing a loop release arm.
Figure 7A:
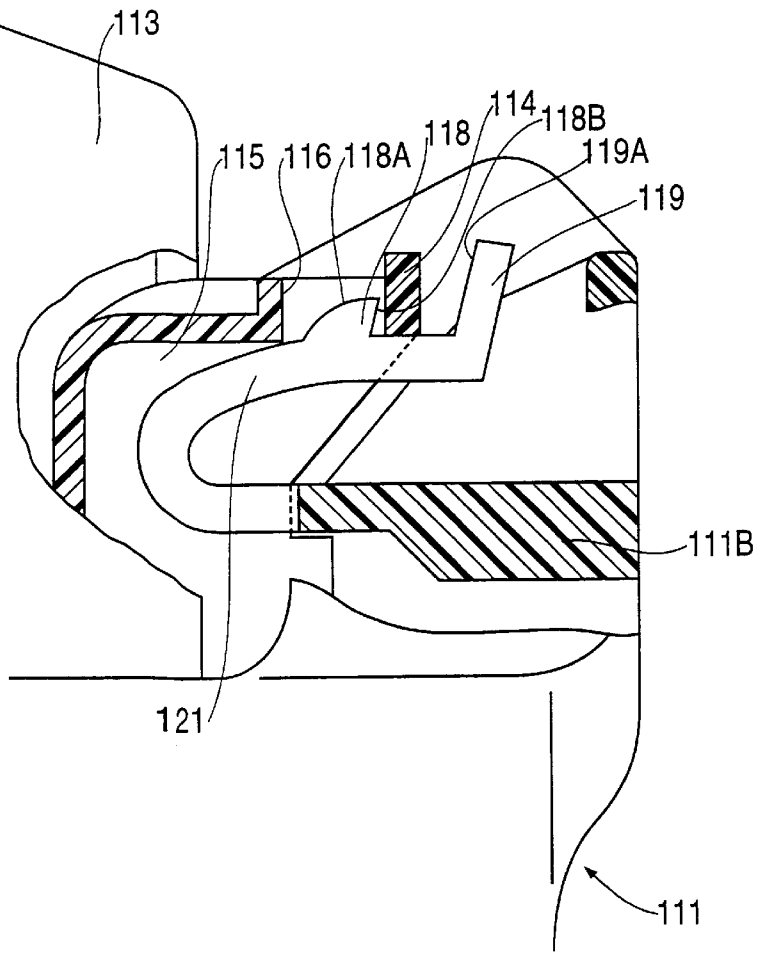
FIG. 7*a* is a partially cut away enlarged side view of embodiment 2 showing the lever in a latched position.
Figure 9:
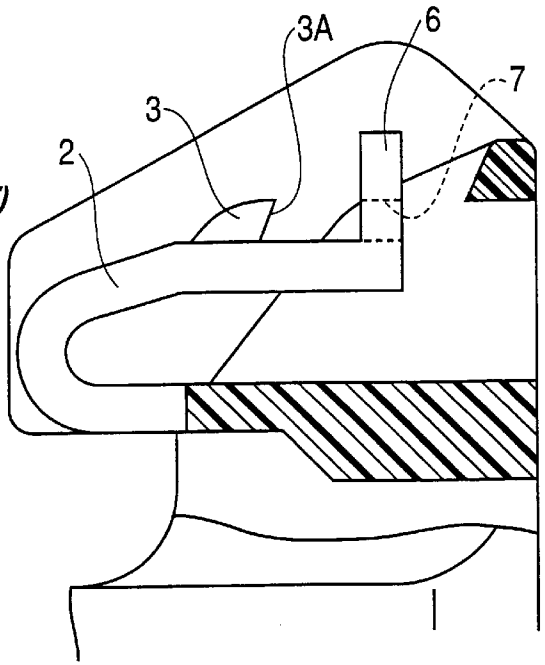
FIG. 9 (PRIOR ART)
FIG. 9 is a partially cut away enlarged side view of the prior art.
Figure 10:
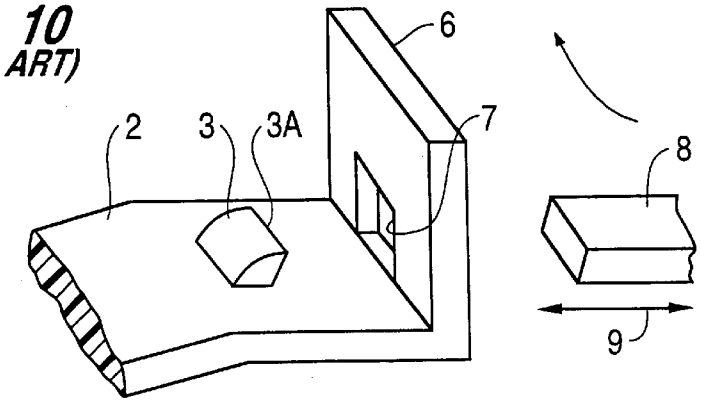
FIG. 10 (PRIOR ART)
FIG. 10 is an isometric view of the prior art example illustrating a mould tool insert.
Figure 8:
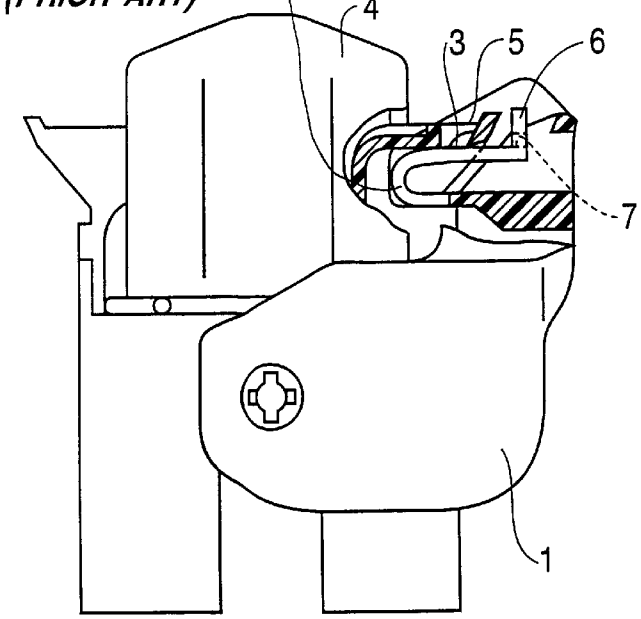
FIG. 8 (PRIOR ART)
FIG. 8 is a partially cut away side view of a prior art example.

A third embodiment is illustrated in FIG. 7*b* and differs from the embodiment of FIG. 7*a* only in that the release member 221 is moulded in a complete loop to the lever 211. When the release member 219 is pressed in the downwards direction, the upper limb of the release member 221 deflects inwardly to permit the protrusion 218 to disengage from the stopping hole 216. Operation of this embodiment is as previously described. Forming the release member 221 in a loop allows a stronger resilient latching force to be exerted, or alternatively permits the dimensions of the release member to be reduced.

The present invention is not limited to the embodiments described above with the aid of figures. For example, the possibilities described below also lie within the technical range of the present invention. Moreover, the present invention may be embodied in various ways other than those described below without deviating from the scope thereof.

(1) In the above embodiments, a case was described relating to the latched position of the lever of a lever type connector. However, the present invention can also be applied to other locking devices such as a locking device for locking two mutually fitting connectors in a fitted state.

(2) In the above embodiments, a case was explained where the facing face 19A of the operating member 19 is parallel to the stopping face 18B. However, according to the present invention, it may be equally arranged so that the space between the facing face and the stopping face gradually increases in the direction of mould removal (FIG. 7*b*).

We claim:

1. A housing for an electrical connector including a generally U-shaped pivotal lever having a pair of arms and a connecting portion that connects the arms, a resilient latching member overlying said connecting portion of said lever and adapted for resilient movement toward and away from said connecting portion, and a receiving member having a recess for receiving said latching member when the lever is moved to a latched position, said latching member having a protrusion and a release arm extending in a first direction generally away from said connecting portion, said protrusion having an abutment face facing said release arm, the abutment face overhanging said latching member at an acute angle thereto and being adapted for latching engagement in said recess of said receiving member, and the release arm having an inner face facing said abutment face of said protrusion and a pressing face on a distal end thereof, said release arm extending substantially beyond said protrusion in said first direction to provide easy access to the pressing face for a user to depress the latching member and release the latching member from said receiving member, said inner face and said abutment face being parallel to one another or slightly divergent in the first direction so that the moulding process is simplified.

2. A housing according to claim 1 wherein said inner face and said abutment face are flat and substantially rectangular.

3. A housing according to claim 1 wherein said release arm, protrusion and latching member have widths which are generally equal in size. width.

4. A housing according to claim 1 wherein said latching member is a cantilevered arm.

5. A housing according to claim 1 wherein said protrusion has a contact face facing away from said release arm, said contact face connecting said latching member and said abutment face.

6. A housing according to claim 5 wherein said contact face is convex.

7. A housing according to claim 5 wherein said latching member is a cantilevered arm.

8. A housing according to claim 7 wherein said latching member has a direction of fitting in said corresponding part, said release arm being substantially perpendicular to said direction of fitting.

9. A housing according to claim 8 wherein the latching member is pivotally attached with respect to said corresponding part and said direction of fitting is arcuate.

10. A housing according to claim 1 wherein said inner face is longer in said same direction than said abutment face.

11. A housing according to claim 10 wherein said release arm, protrusion and latching member have widths which are generally equal in size.

12. A housing according to claim 10 wherein said latching member is a cantilevered arm.

13. A housing according to claim 10 wherein said inner face has a width which is substantially equal in size to a width of said abutment face.

14. A housing according to claim 13 wherein said release arm, protrusion and latching member have widths which are generally equal in size.

15. A housing according to claim 1 wherein said inner face has a width which is substantially equal in size to a width of said abutment face.

16. A housing according to claim 15 wherein said latching member is a cantilevered arm.

* * * * *